US006169782B1

(12) United States Patent
Zetterlund

(10) Patent No.: US 6,169,782 B1
(45) Date of Patent: Jan. 2, 2001

(54) X-RAY SYSTEM WITH INTERNAL POWER SUPPLY INCLUDING BATTERY POWER AND CAPACITIVELY STORED POWER

(75) Inventor: Lennart Zetterlund, Bro (SE)

(73) Assignee: Siemens-Elema AB, Solna (SE)

( * ) Notice: Under 35 U.S.C. 154(b), the term of this patent shall be extended for 0 days.

(21) Appl. No.: 09/261,187

(22) Filed: Mar. 3, 1999

(30) Foreign Application Priority Data

Mar. 25, 1998 (SE) ..... 9801008

(51) Int. Cl.[7] ..... H05G 1/24

(52) U.S. Cl. ..... 378/103; 378/101; 378/102; 378/114; 378/115

(58) Field of Search ..... 378/101, 102, 378/103, 114, 115; 323/266

(56) References Cited

U.S. PATENT DOCUMENTS

| | | | | |
|---|---|---|---|---|
| 3,878,394 | | 4/1975 | Golden | 378/102 |
| 4,322,623 | * | 3/1982 | Grady | 378/103 |
| 4,797,907 | | 1/1989 | Anderson | 378/101 |
| 5,111,493 | * | 5/1992 | Siedband | 378/103 |
| 5,226,064 | * | 7/1993 | Yahata et al. | 378/4 |
| 5,469,350 | | 11/1995 | Nishio et al. | 363/55 |
| 5,631,814 | | 5/1997 | Zak | 363/37 |

* cited by examiner

*Primary Examiner*—David V. Bruce
*Assistant Examiner*—Allen C Ho
(74) *Attorney, Agent, or Firm*—Schiff Hardin & Waite

(57) ABSTRACT

A portable x-ray system includes an x-ray source, an internal power supply for supplying an input voltage, and a voltage converter in electrical connection between the power supply and the source. The converter varies the input voltage from the power supply to provide an output voltage useable in the x-ray source to generate x-rays of a predetermined energy. The power supply includes a battery power store, a capacitor power store, and a switching unit to selectively connect the power stores to the voltage converter individually or together to provide the input voltage to the voltage converter during an exposure.

9 Claims, 1 Drawing Sheet

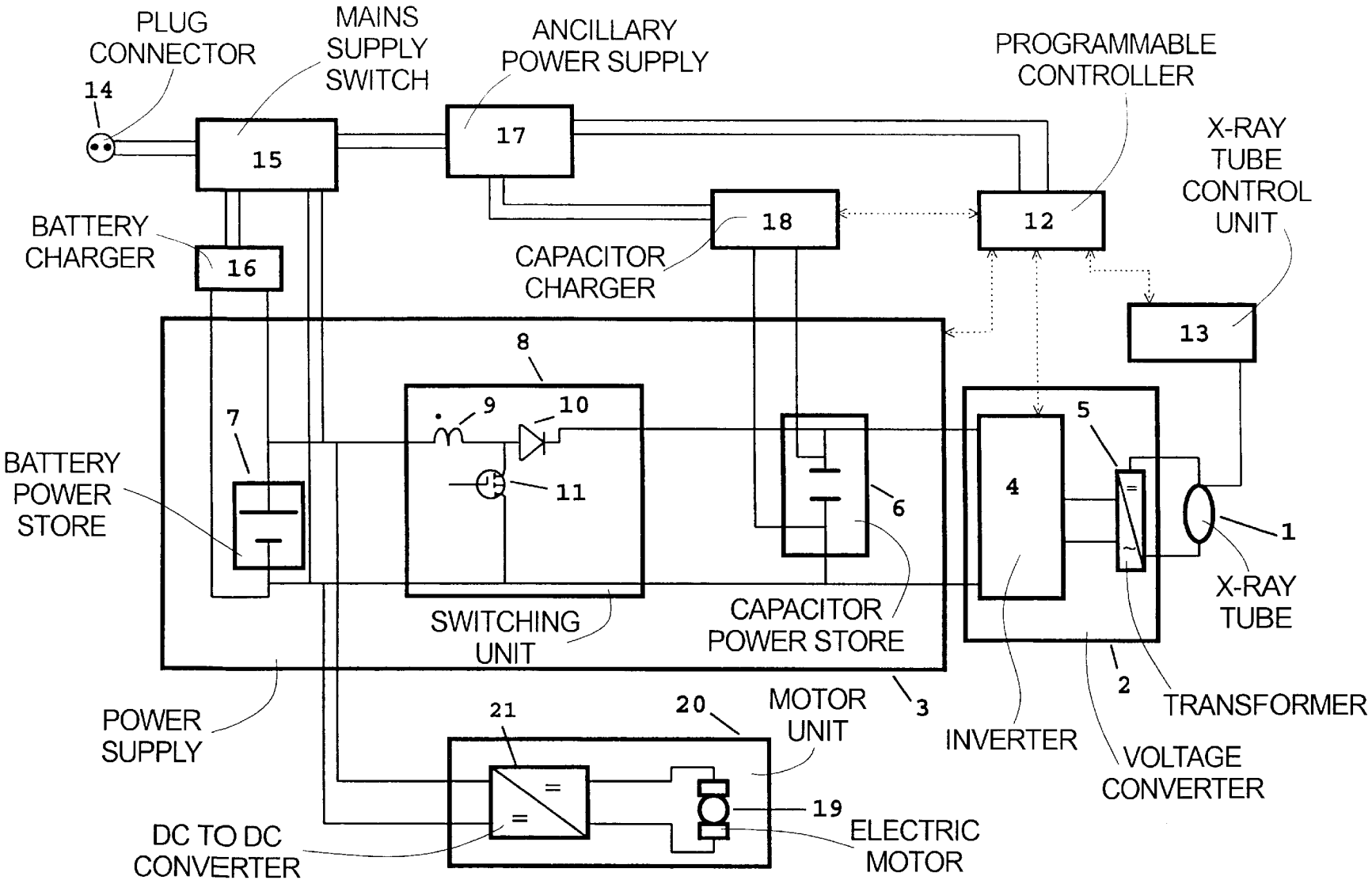
X-RAY TUBE CONTROL UNIT
13
1
X-RAY TUBE
TRANSFORMER
VOLTAGE CONVERTER
2
5
4
INVERTER
PROGRAMMABLE CONTROLLER
12
3
6
CAPACITOR POWER STORE
MOTOR UNIT
19
ELECTRIC MOTOR
18
20
CAPACITOR CHARGER
ANCILLARY POWER SUPPLY
17
8
10
11
9
SWITCHING UNIT
21
MAINS SUPPLY SWITCH
15
16
7
PLUG CONNECTOR
14
BATTERY CHARGER
BATTERY POWER STORE
POWER SUPPLY
DC TO DC CONVERTER

X-RAY SYSTEM WITH INTERNAL POWER SUPPLY INCLUDING BATTERY POWER AND CAPACITIVELY STORED POWER

BACKGROUND OF THE INVENTION

1. Field of the Invention

The present invention relates to an x-ray system and in particular to a portable x-ray system equipped with an internal power supply.

2. Description of the Prior Art

Known portable x-ray systems generally have an x-ray source which is usually an x-ray tube, a low storage voltage battery (typically several hundred volts) power supply and a voltage converter for stepping up the voltage supplied by the power supply to the high voltage (typically several tens of kilovolts(kV)) needed by the x-ray source to create a field in which electrons are accelerated before hitting a metal target and generating the x-rays. These systems are then used in conjunction with any one of a number of known image gathering devices, such as photographic plates or fluoroscopes to generate an x-ray image of an object, such as part of a patient in a hospital environment. Since the quality of the image thus created will generally depend on the penetration of the x-rays used and the exposure time (during which time any movement of the object will cause a blurring of the image), known x-ray systems usually provide a user with selectivity as to either or both of the dose and dose rate. The degree of selectivity of these parameters ultimately depends on the nature of the power supply used and in particular on the level and duration of the voltages that can be generated by the power supply.

One known type of portable x-ray system has an internal power supply having a storage battery arrangement formed by a number of individual lead/acid accumulators connected in series to provide the required output voltage to the converter, which usually includes a step-up transformer. This type of arrangement has the advantage that such accumulators, or similar battery-type energy storage media, provide a suitable voltage output over a relatively long time period. However, such batteries are relatively bulky and heavy which is a problem if the x-ray system is intended to be portable. This is particularly true if the system is required to generate a relatively high dose, short exposure time x-ray output, for example as is needed for short duration, deep penetration depth examinations. In this case a correspondingly large voltage (typically 300–400 V, needs to be supplied from the power source which requires between 25 to 33 bulky 12V lead acid accumulators, thus reducing the portability of the system.

Another known type of x-ray system is described in U.S. Pat. No. 3,878,394. In this known system, the battery store is used to charge a capacitor which, because of the electrical characteristics of capacitors, when discharged provides directly a sufficiently high voltage for use in the generation of a high dose, short exposure time x-rays, much more readily than is the case with the battery store. These same electrical characteristics, however, mean that a relatively large capacitance, which in practice usually represents a large number of capacitors, is needed if long exposure times are required, which is relatively expensive.

SUMMARY OF THE INVENTION

It is an object of the present invention is to provide an x-ray system in which some of the disadvantages of the known power supplies are reduced.

The above object is achieved in accordance with the invention in an x-ray system having a hybrid power supply that includes both a storage battery arrangement, for example rechargeable batteries such as lead/acid accumulators, and a capacitor power storage arrangement which are switchable during an exposure to provide an output from the supply that is generated by one or both (either sequentially or contemporaneously) of them. In this way a relatively high voltage, hence a short exposure time, can be achieved without the need for as high a number of batteries as would be required in a supply composed exclusively of storage batteries, and a long exposure time can be obtained without the need for as high a number of capacitors as would be required in a supply composed exclusively of capacitors. Thus an x-ray system having an increased flexibility in the choice of exposure time is provided while still remaining relatively portable and inexpensive.

Preferably the switching is conducted by, in sequence, first connecting the capacitor store and then the battery store to the input of the converter. This enables short exposure times to be used since power is taken initially from the capacitor supply which is better suited for providing a high dose short duration output as is necessary for short exposure times.

Means may be provided to connect an external alternating current power supply, for example the mains electricity supply, to charge the capacitor power store. This provides a further source of power supply to the x-ray source and may be used to extend the supply time of the battery power store.

Additionally or alternatively, the battery power store may be used to charge the capacitor store. This has the advantage that several exposures may be made before the power store has to be either replaced or, preferably, recharged using an external power source. This permits the portable operation of the x-ray system over an extended period of time.

DESCRIPTION OF THE DRAWINGS

The single FIGURE is a block diagram of an x-ray system constructed and operating according to the present invention.

DESCRIPTION OF THE PREFERRED EMBODIMENTS

In the FIGURE, solid lines connecting the blocks represent power connections whereas the broken arrows represent control signal connections. The x-ray system according to the present invention shown in the FIGURE includes an x-ray tube 1 which is supplied with a high voltage from a voltage converter 2 which itself receives an input voltage from a storage type power supply 3.

The voltage converter 2 includes an inverter 4 and a step-up transformer arrangement 5. The inverter 4 is configured in a standard manner, as a square wave inverter, to provide an alternating current (AC) output to the high voltage step up transformer arrangement 5. This transformer arrangement 5 then provides a direct current (DC) high voltage supply to the x-ray tube 1.

The input to the voltage converter 2 is provided by the power supply 3 which includes a capacitor power store 6 (for example six 15 mF capacitors connected to provide a 350 V output) and a battery power store 7 (for example sixteen 12V lead/acid accumulators connected to provide a 192V output). A switching unit 8, which operates to enable the power supply 3 to selectively supply the voltage to the converter 2 from either the capacitor store 6 or the battery store 7, is also contained within the power supply 3. The switching unit 8 includes an inductor 9 and a rectifying diode 10, connected to enable a boosted voltage to be supplied from the battery store 7, and a MOSFET switch 11. The switch 11 is operable such that power from the battery is switched to the output of the power supply when the voltage from the capacitor store 6 falls to a predetermined level, dependent on the required exposure time and the required dose.

A programmable controller 12 is also provided to receive user input information, such as desired x-ray energy, dose and exposure time, as well as information about the operation of the system, such as information about the voltage level output from the supply 3 and the filament temperature in the x-ray tube 1. The controller 12 then provides control signals to the power supply 3, the voltage converter 2 and the x-ray tube control unit 13 in order to control the x-rays emitted from the x-ray system in dependence on the received information. The x-ray tube control unit 13 is in electrical connection with the x-ray tube 1 so as to control the tube filament current and hence the number of electrons generated for acceleration in the electric field created by the applied high voltage.

The programmable controller 12 also provides signals to the inverter 4, in order to control the frequency and pulse shape of the AC output so as to provide a stable high voltage supply to the tube 1.

Optionally, an external AC or so-called "mains" supply can be connected to the system by means of a plug connector 14 and mains supply switch 15, as shown in the FIGURE. The switch 15 is a three-state rotary switch to allow the selection of one of three modes: battery charging; battery power; and mains power. In battery charging mode the mains supply switch 15 operates so that mains power passes to the battery charger 16 and through an ancillary power supply 17 to provide power to the programmable controller 12. In battery power mode the switch 15 is set so that power to the ancillary supply 17 is provided from the battery store 7 which also provides power to a capacitor charger 18 which is used to charge the capacitor store 6 before an exposure is made. Finally, in mains power mode the switch 15 is switched so that power from the mains is fed to the capacitor charger 18. Optionally, when mains powered, the programmable controller 12 may control the power supply 3 so that no power is taken from the battery store 7 during an exposure.

The x-ray system additionally includes a carriage (not shown) on which are mounted the other components of the x-ray system. The carriage may conveniently be provided with wheels (not shown) that are driven by a DC motor 19 in a motor unit 20. The motor unit 20 additionally includes a DC to DC converter 21 which receives a voltage from the battery power store 7 and converts it to a voltage suitable for use by the motor 19.

Thus in the present example the battery power store 7 is used to power the x-ray tube 1, to charge the capacitor store 6 and to drive the motor 19.

Although modifications and changes may be suggested by those skilled in the art, it is the intention of the inventor to embody within the patent warranted hereon all changes and modifications as reasonably and properly come within the scope of his contribution to the art.

I claim as my invention:

1. An x-ray system comprising:

an x-ray source;

a power supply for supplying an input voltage;

a voltage converter connected between said power supply and said x-ray source for converting said input voltage to an output voltage supplied to said x-ray source, said converter comprising means for varying a conversion between said input voltage and said output voltage to provide a selectable output voltage for allowing said x-ray source to generate x-rays of a predetermined energy; and said power supply comprising a battery power store and a capacitor power store and switching means for selectively connecting at least one of said battery power store and said capacitor power store at a time to produce said input voltage.

2. An x-ray system as claimed in claim 1 wherein said power supply has a power supply output across which said input voltage is present, and wherein said switching means comprises means for connecting said battery power store and said capacitor power store in sequence to said power supply output.

3. An x-ray system as claimed in claim 2 wherein said capacitor power store provides a first voltage to said power supply output which changes from a first level to a second level as said capacitor power store discharges, said first level being higher than said second level, and wherein said battery power store provides a second voltage to said power supply output, said second voltage having an intermediate level between said first and second levels, and wherein said switching means comprises means for initially connecting said capacitor power store to said power supply output and for subsequently connecting said battery power store to said power supply output if and when a voltage at said power supply output falls to said second level.

4. An x-ray system as claimed in claim 1 wherein said power supply comprises means for providing an adjustable voltage level at a power supply output from said battery power store.

5. An x-ray system as claimed in claim 4 wherein said power supply comprises means for adjusting said voltage level dependent on said predetermined energy of said x-rays.

6. An x-ray system as claimed in claim 1 wherein said voltage converter comprises an inverter and a high-voltage transformer electrically connected to said inverter for providing a high-voltage supply to said x-ray source.

7. An x-ray system as claimed in claim 1 further comprising a connection between said battery power store and said capacitor Power store for allowing said battery power store to charge said capacitor power store.

8. An x-ray system as claimed in claim 1 further comprising means for connecting said power supply to an external alternating current power source.

9. An x-ray system as claimed in claim 1 further comprising a carriage on which said x-ray source and said power supply are mounted, and an electric motor on said carriage for propelling said carriage, and wherein said converter comprises means for converting a voltage supplied by said battery power store to a voltage useable by said electric motor for propelling said carriage.

* * * * *